US005935408A

United States Patent [19]

Kinard et al.

[11] Patent Number: 5,935,408

[45] Date of Patent: Aug. 10, 1999

[54] ELECTROLYTE FOR ANODIZING VALVE METALS

[75] Inventors: John T. Kinard, Simpsonville; Brian J. Melody, Greer; Philip M. Lessner, Simpsonville, all of S.C.

[73] Assignee: Kemet Electronics Corporation, Greenville, S.C.

[21] Appl. No.: 09/182,992

[22] Filed: Oct. 30, 1998

Related U.S. Application Data

[62] Division of application No. 08/948,783, Oct. 10, 1997, Pat. No. 5,837,121.

[51] Int. Cl.[6] ..... C25D 11/26; C25D 11/06

[52] U.S. Cl. ..... 205/234; 106/287.26; 205/318; 205/322; 205/332

[58] Field of Search ..... 205/318, 322, 205/332, 106, 107, 108, 234, 324; 106/287.26

[56] References Cited

U.S. PATENT DOCUMENTS

| | | | |
|---|---|---|---|
| 537,474 | 11/1895 | Windsor-Bowen et al. | 429/241 |
| 3,359,191 | 12/1967 | Minami et al. | 205/171 |
| 3,796,644 | 3/1974 | Bernard | 205/332 |
| 4,196,060 | 4/1980 | Patrie et al. | 205/50 |
| 4,383,897 | 5/1983 | Gillich et al. | 101/459 |
| 4,388,156 | 6/1983 | Gillich et al. | 205/235 |
| 4,400,241 | 8/1983 | Braithwaite et al. | 203/18 |
| 5,037,459 | 8/1991 | Spruill et al. | 55/387 |
| 5,385,662 | 1/1995 | Kurze et al. | 205/316 |
| 5,587,871 | 12/1996 | Ue et al. | 361/504 |

FOREIGN PATENT DOCUMENTS 537474 6/1941 United Kingdom .

OTHER PUBLICATIONS

Melody et al., "An Improved Series of Electrolytes for Use in the Anodization of Tantalum Capacitor Anodes," Presented at the Capacitor and Resistor Technology Symposium (C.A.R.T.S. '92), Mar. 17, 1992, pp. 1–11.

Patent Abstracts of Japan, vol. 10, No. 373, Abs. Grp. No. C391, abstracting Appl. No. 60–8438 Dec. 1986.

*Primary Examiner*—Kathryn Gorgos
*Assistant Examiner*—William T. Leader
*Attorney, Agent, or Firm*—Banner & Witcoff, Ltd.

[57] ABSTRACT

An electrolytic solution comprising glycerine and dibasic potassium phosphate. The electrolytic solution has a water content of less than 1000 ppm and is prepared by mixing the glycerine and the dibasic potassium phosphate and then heating to about 150 to 180° C. for about 1 to 12 hours. A method of anodizing a metal comprising forming a film on the metal with an electrolytic solution comprising glycerine and dibasic potassium phosphate. The metal is preferably a valve metal, such as tantalum, and the film is formed at a temperature of 150° C. or higher.

4 Claims, No Drawings

ELECTROLYTE FOR ANODIZING VALVE METALS

This application is a divisional of Ser. No. 08/948,783, filed Oct. 6, 1997, now U.S. Pat. No. 5,837,121.

BACKGROUND OF THE INVENTION

For over a century, the so-called "valve" metals (i.e. metals which form adherent, electrically insulating anodic oxide films, such as aluminum, tantalum, niobium, titanium, zirconium, silicon, etc.) have been employed for film applications. These applications include electrolytic capacitors, rectifiers, lightning arrestors, and devices in which the anodic film takes the place of traditional electrical insulation, such as special transformers, motors, relays, etc.

When biased positive in appropriate (i.e. non-corrosive) aqueous or partially aqueous electrolytes, typical valve metals, such as aluminum or tantalum become coated with a dielectric film of uniform thickness. At constant temperature, the film thickness is proportional to the applied voltage and the rate of film growth is directly proportional to the current density. These properties are described at length in L. Young's book, "Anodic Oxide Films" (1961, Academic Press, London).

Additionally, the thickness of anodic films at constant voltage is directly proportional to the absolute (Kelvin) temperature of the electrolyte. This was demonstrated by A. F. Torrisi ("Relation of Color to Certain Characteristics of Anodic Tantalum Films", *Journal of the Electrochemical Society* Vol. 102, No. 4, April, 1955, pages 176–180) for films on tantalum over the temperature range of 0° C. to 200° C. and with applied voltages up to 500 volts, presumably with the glycol-borate electrolytes in use at the time (these electrolytes always contain some free water, produced by esterification, which supplies oxygen for film formation).

The above relationships of voltage, temperature, current density and anodic film thickness have been successfully exploited by the manufacturers of electrolytic capacitors to obtain anodic films of different thickness according to the finished device voltage and capacitance requirements.

Anode foil for aluminum capacitors is usually anodized, following suitable etching processes to increase surface area, by slowly passing the foil through a series of anodizing tanks, each biased progressively more negative vs. the aluminum foil. The slow rate of transit of the foil through each tank allows the anodic film to reach the limiting thickness for the voltage difference between the foil and each tank of electrolyte.

In the manufacture of tantalum capacitors, powder metallurgy techniques are used to produce slug-like capacitor bodies of significantly less than theoretical density and having high internal surface area. The anodic dielectric film is produced by immersing the capacitor bodies in an electrolyte and applying current (usually a constant current) until the desired voltage is reached and then holding the anode bodies at this voltage for a time sufficiently long to insure a uniform film thickness within the interstices of the anode bodies.

Upon application of suitable cathode contacts, anode materials covered with anodic films as described above, become positive capacitor "plates" in polar capacitors in which the anodic film serves as the dielectric. These devices are characterized by a relatively high capacitance per unit volume and relatively low cost per unit of capacitance compared with electrostatic capacitors.

These devices are also "polar" devices, which show so-called "valve" action, blocking current within the rated voltage range when the valve metal is positively biased and readily passing current if the valve metal is biased negative (early rectifiers were based upon this fact and contained aluminum or tantalum as the valve metal).

It is readily apparent that modifications of the anodizing process resulting in anodic oxide films having high dielectric constant and low film thickness per volt are advantageous as they tend to maximize capacitance per surface area of valve metal at a given anodizing voltage. C. Crevecoeur and H. J. DeWit, in a paper entitled: "The Influence of Crystalline Alumina on the Anodization of Aluminum" (Presented at the Electrochemical Society Meeting in Seattle, Wash., May 21–26, 1978) report that aluminum anodized in very dilute citric acid solutions gives rise to a "crystalline" anodic oxide with a thickness of 8 angstroms per volt, while the film produced in traditional dilute borate electrolytes has a thickness of 11 angstroms per volt. This results in an approximate 30% capacitance advantage for the films produced in the carboxylic acid solution.

The dielectric properties (i.e. withstanding voltage, dielectric constant) of the anodic film appear to be influenced to an extraordinary degree by the presence of even a small amount of carbonaceous material incorporated during anodizing.

U.S. Pat. No. 4,159,927 indicates that anodizing electrolytes containing small quantities of hydroxy-carboxylic acids (e.g. tartaric acid, malic acid, citric acid, etc.) in addition to the major boric acid solute give rise to anodic films on aluminum containing less than 1% carbon, but having profoundly different diffusion properties as indicated by their much lower rate of reaction with water to form hydrated species compared with traditional films containing no carbonaceous species. In aqueous electrolytes containing minor amounts of hydroxy-carboxylic acids, the incorporated carbonaceous species originates with the carboxylic acid carbon. This is not necessarily true for all electrolytes, however.

Solutions of boric acid in formamide give rise to anodic films on aluminum at 60–100° C. which contain a significant amount of incorporated carbonaceous species ("Properties and Mechanism of Formation of Thick Anodic Oxide Films on Aluminum from the Non-Aqueous System Boric Acid-Formamide", S. Tajima, N. Baba, and T. Mori, *Electro-Chemical* Acta, 1964, Vol. 9, pages 1509 to 1519).

GB 2,168,383A describes an anodizing process employing aprotic polar solvent solutions of phosphoric acid or soluble amine phosphate, operated below about 30° C. Anodic films formed on titanium coupons in these electrolytes have been demonstrated to contain incorporated carbonaceous material. ("Anodizing Mechanism in High Purity Titanium", H. W. Rosenberg, M. S. Cooper, and Karl Bloss; presented at the "Titanium '92" 7th International Conference on Titanium, San Diego, Calif., 1992).

More recently, Ue, et al. have demonstrated that anodic films on aluminum anodized in anhydrous (about 10 ppm water) 4-butyrolactone containing quaternary ammonium salts exhibit a dielectric constant enhancement of as much as 10 to 20 times higher than that obtained with traditional aqueous anodizing electrolytes (Japanese Patent No. 8-134693). These authors have extended this anodizing method to include anhydrous solutions of quaternary ammonium salts of oxygen-containing mineral acids in ethylene glycol and have obtained a similar, though less pronounced elevation of the dielectric constant of anode films on aluminum (Japanese Patent No. 8-134,692). These authors have also claimed in the technical paper, "Anodic Oxidation of Valve Metals in Non-Aqueous Electrolyte Solutions", (Electrochemical Society Proceedings, Vol. 96–18, pages 84–95) to have extended this anodizing method to titanium, zirconium, hafnium, niobium, and tantalum, but give no supporting data for this claim. The anodic film growth in the electrolytes of Ue, et al. is traditional so far as the anodizing kinetics are concerned, with the film growing to a thickness dependent upon voltage.

The elevated dielectric constant of anodic films grown on titanium in low water content phosphate solutions in 4-butyrolactone was disclosed in GB 2,168,383A, in example no. 4, in which a dielectric constant of 8 times that of traditionally formed tantalum oxide was produced at 100 volts. In a further preferred embodiment, disclosed in example No. 7, anodic titanium oxide produced at 500 volts in a low water content phosphate solution in N-methyl-2-pyrrolidone gave a capacitance of over 30 times that of a equal surface area of tantalum anodized to 500 volts in a traditional electrolyte.

Unfortunately, all of the above anodizing methods which give rise to an elevation of the dielectric constant of the anodic oxide have major drawbacks or limitations when used in a production scale anodizing process. Quaternary ammonium salts are expensive and difficult to obtain. Amines, such as pyridine and the picolines, which form electrolyte-soluble phosphate salts tend to be toxic and to have very unpleasant odors. Many of the most suitable solvents, such as 4-butyrolactone, N-alkyl-2-pyrrolidones, dimethyl formamide, dimethyl sulfoxide, etc., are toxic, flammable or are difficult to contain in standard anodizing equipment due to attack of circulation pump seals, etc.

Furthermore, it is very difficult to maintain polar solvent-based electrolytes in an anhydrous condition in a production environment. The reduction in anodic film breakdown voltage and anodizing efficiency for aprotic solvent phosphate solutions containing more than about 2% water are described in GB 2,168,383A, while Ue, et al. describes a factor of three difference in oxide thickness per volt with a 300 ppm increase in electrolyte water content (Electrochemical Society Proceedings paper cited earlier, page 86).

The expedient of simply heating the anodizing electrolytes to temperatures above the boiling point of water to drive off moisture is impractical due to excessive solvent evaporation, increased possibility of fires, loss of volatile amines, and reaction of the solvents with the solutes. At higher temperatures, 4-butyrolactone reacts with amines and phosphates, dimethyl sulfoxide is converted into dimethyl sulfide and dimethyl sulfone and alkyl amides react with phosphates to form phosphoramides, etc.

The simple expedient of employing the methods and solvents, etc., of GB 2168,383A and replacing the phosphoric acid with polyphosphoric acid to reduce the water content has been attempted (U.S. Pat. No. 5,211,832) and, unfortunately, has been found to lead to the production of anodic titanium dioxide films having a dielectric constant of about 20. This value is several times less than that obtained with phosphoric acid according to GB 2,168,383A.

It is desired to provide an anodizing electrolyte or series of electrolytes which have the ability to produce anodic films having high dielectric constant and few flaws. It is also desired to have high thermal stability so that the water content can be maintained at sufficiently low levels with the aid of heat alone (i.e., no need for vacuum-treatment, etc.). In addition it is desired to have safe, low-toxicity, low-objectionable odor components and a near-neutral pH (i.e. a "worker-friendly" composition) and low-cost components (to make mass production affordable). Also desired is inherent stability of composition over the operating life so as to avoid the need for frequent analysis and component additions to maintain the electrolyte composition and relatively low resistivity so as to produce anodic films of uniform thickness with varying separation between anode and cathode surfaces.

SUMMARY OF THE INVENTION

The present invention is directed to an electrolytic solution comprising glycerine and dibasic potassium phosphate. The present invention is further directed to an electrolytic solution having a water content of less than 1000 ppm. In addition, the present invention is directed to an electrolytic solution prepared by mixing the glycerine and the dibasic potassium phosphate and then heating to about 150 to 180° C. for about 1 to 12 hours.

The present invention is also directed to a method of anodizing a metal comprising forming a film on the metal with an electrolytic solution comprising glycerine and dibasic potassium phosphate. The metal is preferably a valve metal, such as tantalum, and the film is formed at a temperature of 150° C. or higher.

It is to be understood that both the foregoing general description and the following detailed description are exemplary and explanatory only and are not restrictive of the present invention as claimed.

DETAILED DESCRIPTION OF THE PREFERRED EMBODIMENTS

It was determined that freshly prepared solutions of dibasic potassium phosphate in glycerine, when used as electrolytes, provide typical anodic tantalum oxide films. The oxide film thickness is proportional to the applied voltage, and the relative thickness per volt of the films is directly proportional to the absolute (i.e Kelvin) temperature of the electrolyte over the temperature range of 125–180° C.

Unexpectedly, it was discovered that glycerine solutions of dibasic potassium phosphate which have been heated to 180° C. for 1–2 hours, or to 150° C. overnight, behaved far differently when employed as anodizing electrolytes at 150° C. or above compared to such solutions that were not thermally treated. Following thermal treatment, the electrolytic solutions provided anodic films on tantalum and other valve metals which were not limited in thickness according to the anodizing voltage, but instead continued to grow thicker so long as voltage was applied.

The electrolytic solutions of dibasic potassium phosphate in glycerine can be prepared, for example, by mixing the phosphate and glycerine together at room temperature such as by string. The dibasic potassium phosphate is added in amounts of about 0.1 to 15 wt %, preferably about 2 to 10 wt %, based on the total weight of solution. The solution is then heated to between about 150 and 180° C. for 1 to 12 hours. The amount of water present in the solution is less than 1000 ppm, preferably less than 900 ppm.

The electrolytic solution of the present invention has a boiling point of about 290 to above 350° C., preferably above about 295° C., and exhibits relatively low vapor pressure and low evaporative loss at temperatures of 150° C. and higher. The electrolytic solution of the present invention has low toxicity and exhibits near-neutral pH (8–9). In addition, the solution exhibits low resistivity and is stable on standing at elevated temperatures of 150°–180° C.

The electrolytic solution of the present invention may be used to produce anodic films on most types of metals including "valve" metals such as aluminum, tantalum, niobium, titanium, zirconium, silicon. Tantalum is the most common valve metal used.

Anodic films, prepared with the electrolytic solution of the present invention, may be produced at constant voltage, with the film thickness being approximately proportional to the time held at voltage at a constant temperature above the range of 125–150° C. The rate of film growth in these solutions is a function of both the applied voltage and electrolyte temperature. There is no known upper limit to the thickness of a film produced in accordance with the present invention.

Relatively uniform thick films can produced within the interstices and on the surface of tantalum powder metallurgy capacitor anodes if the voltage applied to the anode bodies is applied as pulsed direct current with the positive bias continuing for approximately 0.3 seconds or less with an unbiased or open-circuit period of at least 0.3 seconds between pulses. A.C., half-wave A.C., saw-tooth wave forms, etc., can also be used in place of pulsed D.C. to obtain uniform anodic films in these electrolytes.

Film growth rate is dependent on applied voltage with the electrolytes and anodizing conditions of the present invention. Tantalum powder metallurgy capacitor anode bodies that are anodized with constant voltage and direct current result in the formation of an outer anodic film which is much thicker than the anodic film covering the internal anode surfaces (i.e., on the internal surfaces the anodic film grows at a lower rate due to the voltage drop through the electrolyte within the interstices of the anode bodies). This differentiation of film thickness with a thicker anodic film covering the outer envelope of the anode body may be employed to advantage for the purposes outlined in U.S. Pat. No. 4,131,520, which is hereby incorporated by reference, namely the production of a thick outer film which is resistant to mechanical damage and electrical field stress, while maintaining a relatively thin internal film thickness to maximize device capacitance.

There are unlimited applications for the electrolytic solution of the present invention including the production of electrolytic capacitors, rectifiers, lightning arrestors, and devices in which the anodic film takes the place of traditional electrical insulation, such as special transformers, motors, relays, etc. In addition, because of the uniformity obtained with the present invention, the electrolytic solution of the present invention may be used in the production of surgical implants where a minimum of induced currents is desirable. The rapid rate of growth achieved with the present invention also allows for the production of practical anti-seize coatings for connectors and plumbing fabricated from valve metals and alloys.

The film has high thermal stability which is associated with phosphate-doping of valve metal oxides (phosphorus, present as incorporated phosphate, reduces oxygen diffusion at high temperatures by orders of magnitude.) Thus, the present invention may be used to produce thermal oxidation-resistant coatings for titanium and other valve metals useful for aircraft or aerospace applications.

EXAMPLES

The invention will be further described by reference to the following examples. These examples should not be construed in any way as limiting the invention.

Example 1

The solution resistivity vs. temperature for a 10 wt. % solution of dibasic potassium phosphate in glycerine is as follows:

| Temperature, °C. | 1 Khz Resistivity, ohm.cm |
|---|---|
| 90 | 340 |
| 95 | 300 |
| 100 | 255 |
| 105 | 215 |
| 110 | 190 |
| 115 | 165 |
| 120 | 150 |
| 125 | 130 |
| 130 | 123 |
| 135 | 115 |
| 140 | 105 |
| 145 | 95 |
| 150 | 88 |
| 155 | 80 |
| 160 | 75 |
| 165 | 70 |
| 170 | 67 |
| 175 | 62 |
| 180 | 60 |
| 185 | 56 |
| 190 | 54 |
| 195 | 52 |

The resistivity values at temperatures from 90° C. to 180° C. fell within the range of resistivities typical of traditional electrolytes used to anodize tantalum capacitor anodes commercially. See: Melody et al., "An Improved Series Of Electrolytes For Use In The Anodization Of Tantalum Capacitor Anodes", Proceedings of the 1992 Capacitor and Resistor Technology Symposium, Tucson, Ariz., Mar. 17, 1992.

The extreme stability of this electrolyte is reflected by the unchanged 1 KHz resistivity at 125° C. (i.e. 130 ohm.cm) after exposure to 150° C. in open air for several days. The only addition to the solution during the course of this test was a small amount of glycerine to make up for evaporative losses.

Example 2

The resistivity of a more dilute solution, containing 2 wt. % dibasic potassium phosphate in glycerine, was determined.

| Resistivity vs. Temperature, 2% Dibasic Potassium Phosphate in Glycerine | |
|---|---|
| Temperature, °C. | 1 Khz Resistivity, ohm.cm |
| 70 | 2270 |
| 75 | 1900 |
| 80 | 1530 |
| 85 | 1280 |
| 90 | 1070 |
| 95 | 921 |
| 100 | 823 |
| 105 | 700 |
| 110 | 613 |
| 115 | 556 |
| 120 | 505 |
| 125 | 456 |
| 130 | 413 |
| 135 | 377 |
| 140 | 345 |
| 145 | 321 |
| 150 | 295 |
| 155 | 276 |
| 160 | 260 |

-continued

| Resistivity vs. Temperature, 2% Dibasic Potassium Phosphate in Glycerine | |
|---|---|
| Temperature, °C. | 1 Khz Resistivity, ohm.cm |
| 165 | 245 |
| 170 | 230 |
| 175 | 219 |
| 180 | 208 |
| 185 | 199 |
| 190 | 190 |
| 195 | 181 |

The resistivity values at temperatures from 90° C. to 180° C. fell within the typical range of electrolyte solutions used commercially to anodize tantalum capacitor anodes. The solution stability was similar to those having higher solute concentrations, the 130° C. resistivity remained virtually unchanged after exposure to 150° C. in open air for several days.

Example 3

This example demonstrated the unique combination of high solubility of dibasic potassium phosphate in glycerine and high thermal stability of the resulting solutions. Below are results of room temperature solubility tests of the salt in various potential anodizing electrolyte solvents.

| Solvent | Grams of Dibasic Potassium Phosphate/100 ml at 25° C. |
|---|---|
| 4-butyrolactone | (Insoluble) |
| formamide | (Insoluble) |
| propylene glycol | (Insoluble) |
| propylene carbonate | (Insoluble) |
| N-methyl-2-pyrrolidone | (Insoluble) |
| N-ethyl-2-pyrrolidone | (Insoluble) |
| ethylene glycol | 10 |
| glycerine | 12+ |
| diethylene glycol | (Insoluble) |
| triethylene glycol | (Insoluble) |
| polyethylene glycol 300 | (Insoluble) |
| tetra ethylene glycol dimethyl ether | (Insoluble) |
| N-octyl-2-pyrrolidone | (Insoluble) |
| 2-methyl, 1,3-propane diol. | (Insoluble) |
| Polyethylene glycol mono methyl ether 350 | (Insoluble) |

The ethylene glycol solution gave a large amount of precipitate upon heating to 100° C. Of the solvents tested, only glycerine formed solutions stable from room temperature to over 180° C.

Example 4

The non-limiting thickness anodic film-forming behavior was observed with a freshly prepared 10 wt. % glycerine solution of dibasic potassium phosphate as an anomaly in the "age-down" current during the anodizing of a 1 inch wide tantalum coupon, immersed to a depth of 1 inch in the electrolyte and exposed to a voltage of 20 volts.

| Time At Voltage | Current (Amp) | Electrolyte Temp °C. |
|---|---|---|
| (Start) | 0.7 | 178 |
| 1 min. | 0.002 | 180 |
| 2 min. | 0.00121 | 183 |
| 5 min | 0.00061 | 184 |
| 10 min | 0.00027 | 181 |
| 20 min | 0.00017 | 181 |
| 30 min | 0.00012 | 179 |
| 45 min | 0.00013 | 180 |

-continued

| Time At Voltage | Current (Amp) | Electrolyte Temp °C. |
|---|---|---|
| 1 hr 30 min | 0.00058 | 180 |
| 1 hr 45 min | 0.00074 | 180 |
| 2 hrs | 0.00228 | 180 |
| 2 hrs 30 min | 0.00411 | 177 |
| 3 hrs | 0.00921 | 180 |

In traditional anodizing, the current should only decrease with time. The oxide interference color indicated a film thickness equivalent to that produced, under normal anodizing conditions, at 150 volts at 85° C. or 120 volts at 180° C., instead of the expected color indicative of 25 volts at 85° C. or 20 volts at 180° C. (i.e. the film appears to be 6 times as thick as expected under normal conditions).

Example 5

In order to quantitatively determine the anodic film thickness vs. time for films formed in the heat-treated electrolyte, a group of 1-inch wide tantalum coupons was immersed in a 2 wt. % solution of dibasic potassium phosphate in glycerine at approximately 180° C. 20 volts was applied to the group of coupons and a coupon was removed every 30 minutes, for a total of 6 coupons. The electrolyte was heat-treated for about an hour at 180° C. prior to the start of the experiment. The current for the group was read prior to removing each coupon and the results indicated that the rate of film growth was actually increasing with time at voltage.

The anodic films on the coupons were then subjected to ion-milling to reveal the films in profile and the thicknesses were measured using a scanning electron microscope (S.E.M.).

| Time at 20 Volts | Current, Amp | Film Thickness, Angstroms |
|---|---|---|
| 30 Min | 0.0048 (6 coupons) | 750 |
| 60 Min | 0.0198 (5 coupons) | 1,900 |
| 90 Min | 0.0590 (4 coupons) | 5,200 |
| 120 Min | 0.0299 (3 coupons) | 8000–9900 |
| 150 Min | 0.0278 (2 coupons) | 13,700 |
| 190 Min | 0.0142 (1 coupon) | 17,400 |
| Control | 100 V/85° C. | 2,300 |

The nominal thickness of anodic tantalum oxide films formed at 80–90° C. was 20 angstroms/volt, so the 2300 angstrom thickness obtained for the 100 volt traditional film indicates an accuracy limit of approximately +/−15% for the thickness values. Thus, the film produced by a 190 minute exposure to 20 volts in the 180° C. electrolyte had a thickness equivalent to a film produced at approximately 870 volts at 85° C. in traditional anodizing electrolytes.

Karl Fischer analysis indicates that freshly prepared solutions contained approximately 3000 ppm water, while solutions which have been aged for extended periods at 150° C. contained approximately 1000 ppm, or less, water.

Example 6

In order to confirm solution water content and temperature as the controlling parameters for the mechanism of normal vs. non-limiting thickness film growth kinetics, a series of experiments was performed in which tantalum coupons were anodized in dibasic potassium phosphate solutions in glycerine at different temperatures and with different levels of water present.

The approximate temperature at which the onset of non-limiting thickness growth kinetics occurred for dibasic potassium phosphate solutions in glycerine, heat-treated to reduce the water content to less than about 1000 ppm water, was found to lie between 125° C. and 150° C. This was indicated by the current observed during the anodizing (at 20 volts) of 1 cm wide Ta coupons immersed approximately 3 cm into the electrolyte.

| Time at Voltage | Current, 125° C. | Current, 150° C. |
|---|---|---|
| 10 Min | 0.00011 Amp | 0.00032 Amp |
| 20 Min | 0.00006 Amp | 0.00019 Amp |
| 30 Min | 0.00005 Amp | 0.00018 Amp |
| 45 Min | 0.00004 Amp | 0.00021 Amp |
| 60 Min | 0.00004 Amp | 0.00020 Amp |
| 90 Min | 0.00003 Amp | 0.00028 Amp |
| 120 Min | 0.00003 Amp | 0.00031 Amp |
| 135 Min | 0.00003 Amp | 0.00037 Amp |
| 150 Min | (–) | 0.00036 Amp |

The film color at 125° C. was indicative of 23–25 volts/85° C. The film color at 150° C. was indicative of 70–75 volts/85° C.

Example 7

In order to establish that the presence of water at concentrations significantly above about 1000 ppm gave rise to limiting thickness behavior in glycerine solutions of dibasic potassium phosphate, water was added to the cell holding the 150° C. electrolyte during the anodizing run described in Example 6. The impact upon the current flow through the cell (and the resulting film growth rate) are listed below.

| Time At Voltage at 150° C. | Current |
|---|---|
| 150 Minutes | 0.00036 Amp |
| 0.5 ml of water Added - Solution approximately 4000 ppm water | |
| 160 Minutes | 0.00009 Amp |
| 0.5 ml of water Added - Solution approximately 7000 ppm water | |
| 195 Minutes | 0.00004 Amp |

Clearly, the water content is a critical factor, interfering with the production of non-limiting thickness anodic films.

Example 8

In order to illustrate the reversible nature of the inhibiting effect of water on the kinetics of non-limiting thickness anodic film production, a tantalum coupon was first anodized to 20 volts at 150° C. in a glycerine electrolyte containing 2 wt. % of dibasic potassium phosphate and approximately 0.4% water. The electrolyte was then "dried" by heating to 170–200° C. for 3 hours. The coupon was then returned to the 150° C. electrolyte and 20 volts was re-applied.

1) Water-containing Electrolyte

Current after 3 hours=0.000021 Amp

Oxide color indicative of 23–25 volts/85° C.

2) "Dried" Electrolyte

Current after an additional 1½ hours=0.000276 Amp

Oxide color indicative of 80 volts/85° C.

Example 9

In order to determine if the water present in the electrolyte enters the film as a molecular species through simple contact with the anodic film or as an ionic species due to the action of the field, a tantalum coupon was anodized at 20 volts for 2 hours in a "dried" solution of 2 wt. % dibasic potassium phosphate in glycerine at 150° C. The coupon was then immersed in a 150° C. solution of 2 wt. % dibasic potassium phosphate in glycerine containing 4 wt. % water for 30 minutes (the large excess of water was used to magnify any action of the water). The coupon was then returned to the original, "dry" electrolyte, at 150° C., and 20 volts was re-applied. The current density was found to be the same as before the 30-minute soak in the water-containing solution.

Example 10

In order to determine the dielectric constant for anodic films formed on tantalum with the electrolyte and methods of the present invention, a tantalum coupon 1 cm wide was immersed in an electrolyte consisting of 2 wt. % dibasic potassium phosphate dissolved in glycerine. This electrolyte had previously been "dried" to a moisture content below 1000 ppm water by heating overnight at 150° C.

The tantalum coupon was then anodized to 20 volts at 155–156° C. for 2 hours, 18 minutes. The film color indicated a film thickness equivalent to that obtained at 95 volts in traditional electrolyte at 80–90° C. The capacitance of the film was measured using a Gen Rad Model 1692 RLC Digibridge in combination with a 600 ml beaker equipped with a very high surface area tantalum cathode, the circuit being completed through 20 wt. % nitric acid.

100 HZ Capacitance of 7 $cm^2$=4.34 Microfarads (d.f.=6.3%). Thus, 1 $cm^2$=0.62 Microfarad at 95 volt equivalent 85° C. thickness, C.V=58.9 Microfarad. Volts/$cm^2$.

In traditional electrolytes at 80–90° C., tantalum surfaces yield a C.V product of 11.2 Microfarad Volts/$cm^2$. The application of the present invention, then, provides an anodic film having a dielectric constant equal to the normal dielectric constant (i.e. 28) times the ratio of the C.V products/$cm^2$: (58.9/11.2)(28)=approx. 147, more than 5 times the normal dielectric constant.

Example 11

Due to the relatively high d.f. observed with the film described in Example 10, it was thought that the elevated dielectric constant might be the result of oxide non-stoichiometry due to the presence of an excess of tantalum ions in the film (due to the relatively high rate of tantalum ion injection into the film during anodizing with electrolytes of the present invention). In order to correct any potential non-stoichiometry, the coupon from Example 10 was immersed in a traditional anodizing electrolyte at 85° C.

90 volts was applied for 25 minutes.

Initial current=0.82 Milliamp

After 25 minutes, current=0.12 Milliamp

The capacitance was then measured as in Example 10:

100 HZ Capacitance=1.058 Microfarad (d.f.=2.88%).

$$\text{Dielectric Constant} = \frac{(90\ \text{V})}{(95\ \text{V})}\frac{(1.058)}{(4.34)}(147) = 33.9$$

or 21% above the normal value obtained for anodic tantalum oxide.

S.E.M. examination of anodic films formed with the electrolytes and methods of the present invention indicates these films to be relatively smooth, uniform, and generally free from the blister-like flaws present in films formed in traditional electrolytes. This is especially true for thicker films, which would require potentials of hundreds of volts to produce with traditional electrolytes and anodizing techniques.

Example 12

In order to illustrate the use of the present invention for the rapid production of thick oxide films on valve metals, a coupon of grade I, commercially pure titanium was anodized in an electrolyte consisting of 2 wt.% dibasic potassium phosphate dissolved in glycerine. The temperature was varied between 125° C. and 190° C. The anodizing time was 6 hours, with 3½ hours at or above 50° C. The applied voltage was 100 volts in order to obtain rapid film growth, and this voltage approximately a 10-fold higher current than obtained with tantalum at 20–30 volts over the temperature range of 150° C.–180° C. This 10-fold higher rate of film growth resulted in the production of a very thick film (approximately 10 times the maximum thickness for Example No. 5.) S.E.M. examination of the anodic film surface revealed the absence of blisters or other major defects, which is remarkable for a dielectric film of this thickness.

Example 13

A solution of 98 wt % glycerine and 2 wt % dibasic potassium phosphate was predried at 180–185° C. for 2 hours. An anodic film was grown on a tantalum coupon by immersing the coupon in the heat-treated solution and applying 30 volts for 3.5 hours. The solution temperature was held at 180–185° C. The oxide film thickness was found to be in excess of 40,000 angstroms or the equivalent of >2000 volts at 85° C. Under traditional film coating methods, this thickness could not be achieved. Traditional coating methods at most produce 600–700 volts successfully. The present invention allows for functional coatings at least 3 times thicker than previous methods.

It will be apparent to those skilled in the art that various modifications and variations can be made in the compositions and methods of the present invention without departing from the spirit or scope of the invention. Thus, it is intended that the present invention cover the modifications and variations of this invention provided they come within the scope of the appended claims and their equivalents.

What is claimed:

1. An electrolytic solution comprising glycerine and dibasic potassium phosphate which is prepared by mixing the glycerine and the dibasic potassium phosphate and then heating to about 150 to 180° C. for about 1 to 12 hours, wherein the water content of the solution is less than 1000 ppm.

2. The electrolytic solution according to claim 1 wherein the solution comprises about 0.1 to 12 wt % of the dibasic potassium phosphate.

3. The electrolytic solution according to claim 2 wherein the solution comprises about 2 to 10 wt % of the dibasic potassium phosphate.

4. The electrolytic solution according to claim 1 wherein the water content is less than 900 ppm.

* * * * *